United States Patent [19]

Sichel

[11] 4,269,338

[45] May 26, 1981

[54] BALL HOLDER

[76] Inventor: Burton F. Sichel, 23 Evergreen Ave., Livingston, N.J. 07039

[21] Appl. No.: 95,060

[22] Filed: Nov. 16, 1979

Related U.S. Application Data

[63] Continuation-in-part of Ser. No. 871,543, Jan. 23, 1978, abandoned.

[51] Int. Cl.[3] ..... A63B 47/00; A63B 49/00

[52] U.S. Cl. ..... 224/242; 206/805; 211/15; 221/309; 224/45 L; 224/251; 224/252; 224/269; 224/919; 273/29 R; 294/166

[58] Field of Search ..... 224/182, 194, 224–226, 224/235, 242, 247, 248, 251, 252, 269, 45 L; 211/14, 15; 221/307, 309, 310; 248/309 R, 316 D; 273/29 R, 32 D; 206/315 B, 805

[56] References Cited

U.S. PATENT DOCUMENTS

| | | | |
|---|---|---|---|
| 1,610,344 | 12/1926 | Williams | 224/919 |
| 1,778,225 | 10/1930 | Morss | 224/919 |
| 2,074,180 | 3/1937 | Hatley | 224/919 |
| 2,708,061 | 5/1955 | Kotchka | 224/919 |
| 3,497,118 | 2/1970 | Najjar | 224/252 X |
| 3,768,709 | 10/1973 | Kinard | 224/919 |
| 3,777,933 | 12/1973 | Joliot | 224/252 X |
| 3,865,290 | 2/1975 | Sperling | 224/919 |
| 4,042,156 | 8/1977 | Knight | 221/309 X |
| 4,062,482 | 12/1977 | Szalony | 224/919 |

FOREIGN PATENT DOCUMENTS

| | | | |
|---|---|---|---|
| 573899 | 4/1959 | Canada | 224/919 |
| 1056460 | 2/1954 | France | 224/45 L |
| 421449 | 5/1947 | Italy | 224/45 L |
| 271732 | 6/1927 | United Kingdom | 206/805 |
| 326425 | 3/1930 | United Kingdom | 224/919 |

*Primary Examiner*—Stephen Marcus
*Attorney, Agent, or Firm*—Ronald G. Goebel

[57] ABSTRACT

A ball holder, particularly a tennis ball holder, capable of retaining one or two balls and easily attachable to the clothing is provided in which the two ball holder comprises a vertical strut member; an upper planar ball retaining member extending outwardly from the upper edge of said strut member; a lower planar ball retaining member extending outwardly from the lower edge of said strut member; and a cylindrical ball retaining member joined to the central portion of said strut member and lying between said upper and lower planar ball retaining members. The holder preferably employs elastic ball retaining members which extend from the outer regions of the planar ball retaining members to the cylindrical ball retaining member. A single ball retaining member is provided having a lower planar ball retaining member, arched ball gripping members and elastic ball retaining members.

28 Claims, 6 Drawing Figures

BALL HOLDER

CROSS REFERENCE TO RELATED APPLICATIONS

This application is a continuation-in-part of prior U.S. Patent Application Ser. No. 871,543, filed Jan. 23, 1978, now abandoned.

BACKGROUND OF THE INVENTION

This invention is concerned with a ball holder, particularly a tennis ball holder adapted to hold one or two tennis balls.

In tennis, the server usually carries two or three balls to use for his particular service. If he serves and faults with the first ball he can immediately serve another. If he serves with a second ball and nets it he has the third ball to serve. If the first or second service is in play, the player has to carry one or two balls while playing which may interfere with his game, particularly if he uses both hands for some shots.

Some players place any unused balls in the pocket of their tennis shorts. However this may disturb concentration and the ability of the player to manuever on the court since the balls rub against the player's leg and hamper his motion.

Some players dispose of the second and/or third ball by dropping it or throwing it somewhere on the court after the first successful service. This may be distracting to his opponent and also presents the problem of retrieving one or two balls for the next service.

In view of the problems in dealing with extra balls after a successful service, there have been provided in the art, ball holders worn on the player's clothing which are capable of carrying one or two balls, the object of which is to keep the hands free for volleying after a successful service. Ball holders have also been used for golfers as a convenient alternative to reaching into a golf bag for a new ball.

In British Pat. No. 326,425 to Kachow et al, for example, a golf-ball holder or pouch is provided comprising a pair of substantially semi-spherical members hingedly connected together with the lower part of each member cut away to form an opening when the members are in the closed position, through which a part of the ball placed in the holder will protrude and means for attaching one of the members to a part of the clothing of the user.

In U.S. Pat. No. 2,074,180 to F. J. Halley, a tennis ball holder capable of holding one tennis ball is provided comprising a pair of resiliently mounted rings made of a material such as spring wire, whose diameter is substantially less than that of a tennis ball. The rings are mounted to a base at one point in the circumference of each ring to resiliently resist separation. A tennis ball can be inserted in the space between the rings to enter the holder whereafter the rings close upon the ball and retain it.

U.S. Pat. No. 2,708,061 to J. Kotchka, provides a ball holder capable of retaining one or more balls in spaced relationship with respect to the holder whereby each of the balls is readily accessible to a player. The invention employs a curved base to which is secured a helically wound spring having a plurality of convolutions, the number of which is dependent upon the number of balls which the holder is adapted to retain. At each point along the length of the helical spring at which a ball is to be received, the successive convolutions of the helical spring are formed with a space therebetween sufficiently large to insure that a ball forced against said helical spring will automatically seat into the desired space between the successive convolutions.

In U.S. Pat. No. 3,768,709 to W. C. Kenard, a tennis ball holder is provided for elastically gripping a tennis ball which is capable of being secured to an article of clothing. Preferably, the holder is bent from wire in the form of a pair of loops for holding the ball and a pair of U-shaped portions for nipping or crimping an article of clothing, such as a belt or the like.

In U.S. Pat. No. 3,865,290 to C. A. Sperling, a tennis ball holder is provided comprising a light weight concave plastic shell having a plurality of fingers which grip the ball to retain the ball within the shell. The holder is secured to the player's clothing by means of a plate and key/keyhole arrangement.

The present invention, on the other, hand provides a ball holder for holding one or two balls, particularly tennis balls, attachable to the attire of the player which can be loaded or unloaded rapidly without putting stress on the wearer's attire and securely retains a ball or balls even during the strenuous movements of the player such as serving, running and jumping.

The design of the present ball holder employs a novel combination of ball retaining members made of lightweight, solid and inexpensive plastic. The holder does not employ hingedly connected semi-spherical members, resiliently mounted spring wire, helically wound springs, wire loops or a concave plastic shell containing gripping fingers as described in the above patents. Moreover, in certain embodiments of the invention one of the members, besides functioning to retain balls in the holder, can also be used to assist in loading or unloading the holder without causing stress to the attire of the wearer. Such feature is not present in ball holders provided heretofore.

SUMMARY OF THE INVENTION

In one embodiment of the present invention a ball holder, particularly a tennis ball holder, is provided capable of retaining one or two balls and easily attachable to the clothing, such as the belt or waistband of the wearer comprising:

(a) a vertical strut member;

(b) an upper planar ball retaining member extending outwardly from the upper edge of said strut member;

(c) a lower planar ball retaining member extending outwardly from the lower edge of said strut member; and (d) a cylindrical ball retaining member joined to the central portion of said strut member and lying between said upper and lower planar ball retaining members.

Preferably the ball holder further contains an upper pair of elastic ball retaining members extending from the outer edges of the upper planar ball retaining member to the lower edges of the cylindrical ball retaining member. Similarly, a lower pair of elastic ball retaining members extend from the outer edges of the lower planar ball retaining member to the upper edges of the cylindrical ball retaining member. These upper and lower elastic members further prevent a ball or balls retained by the holder from bouncing within and out of the holder.

The holder is also equipped with a means for fastening the holder to the clothing of the player such as a spring clamp located at the top portion of the strut member.

In another embodiment of this invention a single ball holder is provided essentially comprising the lower half of the above described ball holder, viz a vertical strut member, a lower planar ball retaining member and a cylindrical ball retaining member joined to the upper portion of the strut member. This single ball holder also preferably contains a pair of elastic ball retaining members extending from the outer edges of the lower planar ball retaining member to the cylindrical ball retaining member.

The cylindrical member, besides retaining a ball or balls, is also used to assist in loading and removing balls from the holder. By pressing the member in the direction of the body, the holder is held tightly against the body thus permitting fast loading and unloading while reducing pull or stress on the clamp attached to the wearer's attire.

In still another embodiment of this invention, a single ball holder is provided having a vertical strut member, a lower planar ball retaining member and a pair of elastic ball retaining members. In place of the cylindrical ball retaining member there is provided a pair of curved or arched ball gripping members mounted to the top of the strut member forming an outer space therebetween for insertion of the fingers. The strut member is of a width equal to about the width of the inner diameter of the gripping members and has formed therein a pair of vertical elongated slots for insertion over the waistband or belt of the user. Loading of the holder takes place by placing the ball at the top of the gripping members, pressing the ball toward the body and rolling it down over a segment of the elastic members extending across the upper surface of the ball gripping members into the holder. Unloading takes place by inserting the fingers through the space between the gripping members, pressing the ball against the body and rolling the ball upward over the segment of the elastic ball retaining members. This allows fast loading and unloading without stress on the wearer's attire.

By virtue of the present invention, a player can keep balls off the tennis court and within easy reach of the player while at the same time allowing full use of both hands when playing.

DETAILED DESCRIPTION OF THE PREFERRED EMBODIMENTS

Figure 1:
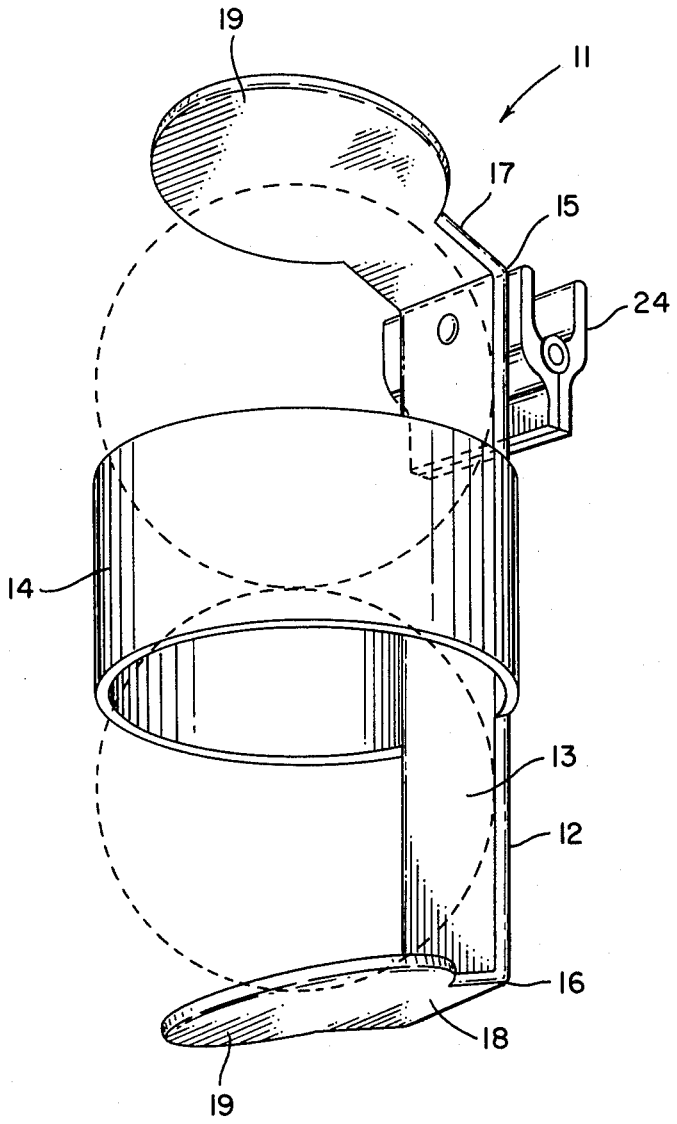
FIG. 1 is a perspective view of one embodiment of the ball holder of this invention for retaining one or two balls.

FIG. 1 shows a perspective view of the tennis ball holder of this invention which is adapted to hold one or two tennis balls.

The holder is shown generally by 11 in its normal operating position containing two tennis balls as indicated by the dotted lines. The holder 11 consists of a strut member 12 about 4½ inches long and about 1½ inches in width made of a solid plastic material such as polyethylene. The inside surface of the strut member 13 may either be flat or rounded to accommodate the rounded surface of a tennis ball and to enhance the strength characteristics of the strut member. Extending outwardly from the strut member 12 at the center portion thereof is a cylindrical ball retaining member 14 also made of a solid plastic. The inside diameter of the cylindrical ball retaining member 14 is substantially the same as the diameter of a tennis ball, i.e. about 2⅝ inches.

Figure 2:
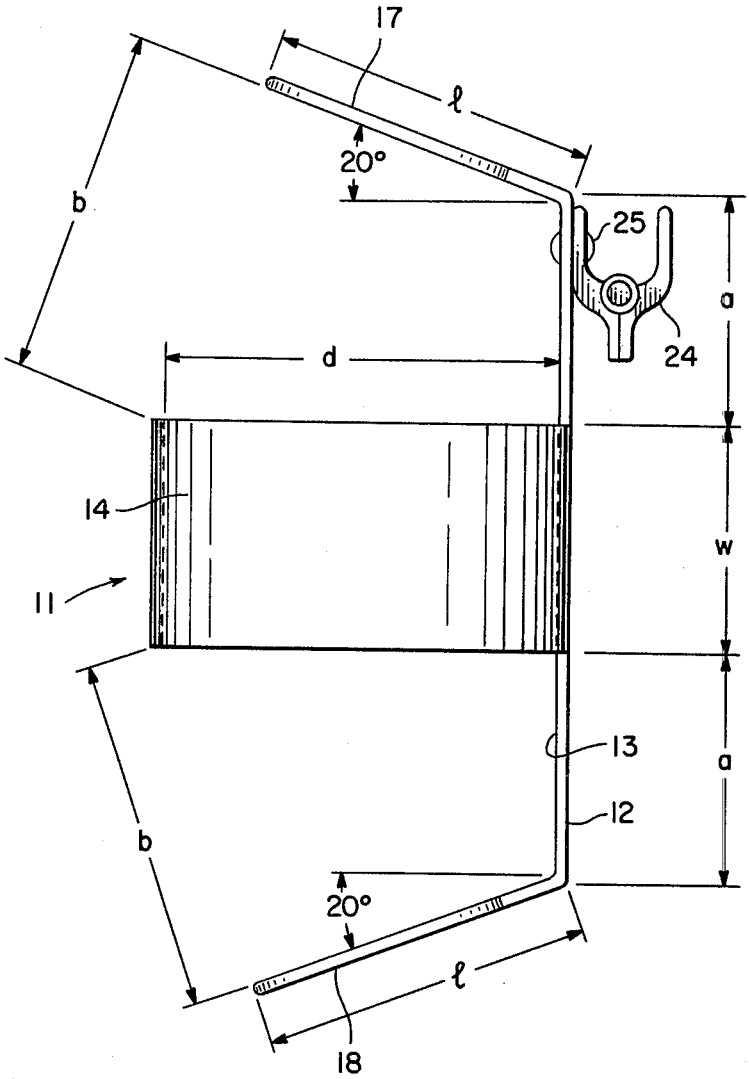
FIG. 2 is a sideview of the ball holder of FIG. 1 illustrating the dimensions and spacings of component parts.

Extending from the upper and lower edges 15 and 16 of strut member 12 above and below cylindrical member 14 are planar ball retaining members 17 and 18 which can also be made of a solid plastic material. Each planar ball retaining member can be positioned at right angles to the strut member. Preferably, however, each planar ball retaining member 17 and 18 is positioned to extend above and below the strut member 12 respectively, at some acute angle from the horizontal or from a plane normal to the strut member 12 at each edge thereof. Preferably this acute angle is from about 10° to about 50° and more preferably about 20° as indicated in FIG. 2. It has been found that by employing an angled aspect to the planar ball retaining members, the tendency of the balls to bounce out of the holder is substantially reduced. The outer portion 19 of each planar ball retaining member as well as the edges thereof should be rounded to avoid sharp surfaces which could injure the wearer or other persons who contact the holder. As shown in FIG. 1, the outer portion 19 of each planar ball retaining member is in a rounded "paddle-like" configuration having a diameter substantially the same or greater than the width of the strut member 12.

Attached to the outside surface of strut member 12 near the top thereof is a means for securing the holder to the wearer such as spring clamp 24. The clamp 24 can then be secured to the wearer's belt or clothing when using the holder. Other means for securing the holder to the wearer may also be employed such as a strap, clip or other fastening means as well known in the art. The width of the clamp or other fastening means should preferably be greater than the width of the strut member 12 e.g. about 2½ inches to reduce the tendency of the holder to sway when in use attached to the attire of the player.

FIG. 2 is a side view of the holder 11 of FIG. 1 showing some of the dimensions thereof. The distance a from each of the strut member 12 to the cylindrical ball retaining member 14 is approximately 1½ inches. The width w of the cylindrical ball retaining member is about 1½ inches. As previously mentioned, the inside diameter d of the cylindrical ball retaining member 14 is about 2⅝ inches, the diameter of a tennis ball. The two planar ball retaining members 17 and 18 extend outwardly from the edges of the strut member a distance e of about 2 inches. The distance b from the end of each planar ball retaining member to each edge of the cylindrical ball retaining member 14 is about 2¼ inches. The thickness of each member 12, 14, 17 and 18 is about 5/64 of an inch. Clamp 24, is shown connected to strut 12 by means of rivet 25 secured to one arm of clamp 24 to prevent rotation of the holder.

Figure 3:
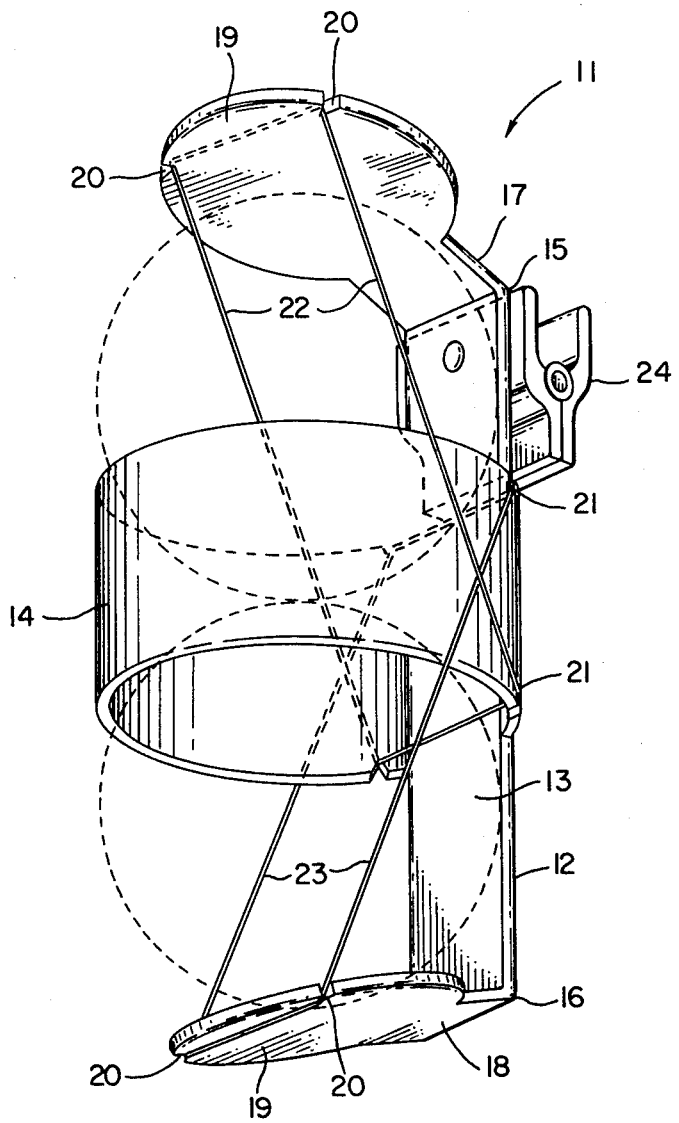
FIG. 3 is a perspective view of another embodiment of the ball holder of this invention containing elastic ball retaining members.

FIG. 3 illustrates another embodiment of the ball holder of this invention which further comprises elastic ball retaining members connected between the planar ball retaining members and cylindrical ball retaining member to prevent bouncing of the balls within and out of the holder during playing.

In this embodiment, each planar ball retaining member 17 and 18 has a pair of opposing grooves 20 notched in the edge of each "paddle" at the outer region thereof about 1½ to 2 inches apart. The cylindrical ball retaining member 14 has two pairs of opposed grooves 21 notched in the upper and lower edges thereof near the junction of the cylindrical ball retaining member 14 and strut member 12.

A rubber band or other thin elastic band material extends around the top surface of the upper planar member 17 at the outer regions thereof through grooves 20 to the grooves 21 in the lower inside edges of the cylindrical ball retaining member 14 and then across the lower surface thereof to provide a pair of elastic ball retaining members 22. Similarly, another rubber band or thin elastic material extends around the lower surface at the outer regions thereof of the lower planar member 18 through grooves 20 of the lower member to the grooves 21 in the upper inside edges of the cylindrical ball retaining member 14 and then across the upper surface thereof to provide a second pair of elastic ball retaining members 23. The elastic ball retaining members 22 and 23 can also be provided by fastening thin elastic materials to the grooves in any suitable manner as for example by knotting, glueing, pinning and the like.

By virtue of the elastic ball retaining members, a ball or balls placed in the holder are more securely restrained from bouncing within or out of the holder during the jostling motions of the wearer while playing.

As shown in FIG. 3, the grooves 20 and 21 are triangularly shaped. However, notches or other geometrical shapes may also be suitably employed such as semicircular, oblong etc.

It is also within the scope of this invention to use other means for retaining the flexible ball retaining members such as holes instead of grooves located at the outer region of the planar ball retaining members. It is also possible to eliminate grooves or holes by merely securing the flexible members directly to the outer region of each planar ball retaining member and cylindrical ball retaining member by any suitable method i.e. glueing, tacking, pinning etc. It is preferred, however, to maintain the segments or sections of the flexible ball retaining member across the lower and upper surface of the cylindrical ball retaining member.

The tennis ball holder of this invention is attached to the clothing i.e. shorts, blouse, belt etc., e.g. at the back of the tennis player, by means of clamp 24 or other suitable fastening means in the position shown in FIG. 1 or FIG. 3. Preferably, the holder is attached to the tennis player about belt high and off center about two inches toward the direction of the player's arms which does not hold the tennis racket when the player is serving.

Two tennis balls are placed in the holder by either placing one ball at a time in the lower and upper section of the holder or by placing one ball in either section followed by displacing that ball with a second ball to the unoccupied section of the holder. Cylindrical ball retaining member 14 acts to restrain both balls from moving in an outward direction from the holder in a plane perpendicular to the plane of the strut member 12. However, one of the most important features of the cylindrical member 14 is to reduce pull or stress on the wearer's attire when loading and removing balls to and from the holder. By pressing the member 14 with a free hand in the direction of the body, the holder can be held tightly against the body while loading or unloading using the fingers of the same free hand thus eliminating stress on the clamp and preventing damage to the wearer's attire. Such feature was not a consideration in ball holders provided heretofore. However, it is essential in sports like tennis where it is necessary that a holder not only be capable of securely holding balls therein during playing but also be capable of fast loading and unloading without developing tears or holes in the player's attire. The planar ball retaining members 17 and 18 prevent movement of the balls in a vertical direction. When angled in the manner described above, they also reduce the tendency of the balls to bounce within their confined space. This tendency to bounce is offset by the inclination and declination of the planar members which acts to set the balls inwardly toward the strut member. The elastic ball retaining members 22 and 23, as previously mentioned keep tension on the ball they bear upon during loading and releasing to further prevent balls from bouncing out of the holder. Each elastic member also holds its respective ball in place to prevent bouncing around when the player is very active such as in running, jumping, quick stops and changing direction. The location of the claimp 24 at the top of the strut 12 reduces sway since the majority of the weight of the holder and balls is located below the clamp.

When one ball is placed in the holder or when one ball is removed from the holder retaining two balls, either the top or bottom ball, the single ball is retained in the holder by a section of the strut member 12, a section of the cylindrical ball retaining member 14, a planar ball retaining member 17 or 18 and a pair of elastic retaining members 22 or 23, as shown in FIG. 3, if also employed. After the second ball is removed, the holder is then loaded with one or two balls and the procedure is repeated.

If the lower ball is removed first, the cylindrical ball retaining member 14 guides the upper ball downward to the lower section of the holder should the upper ball tend to drop as a result of gravity and the movements of the player.

The holder including strut member 12, upper and lower planar ball retaining members 17 and 18 and cylindrical ball retaining member 14 may be fabricated as one unit by plastic molding techniques well known in the art. If flexible ball retaining members are employed, grooves can be easily formed in the appropriate edges of the planar ball retaining members and cylindrical ball retaining member before, during or after fabrication. Alternatively, two or more members may be fabricated as one unit and the remaining unit or units added on by bonding methods well known in the art.

Figure 4:
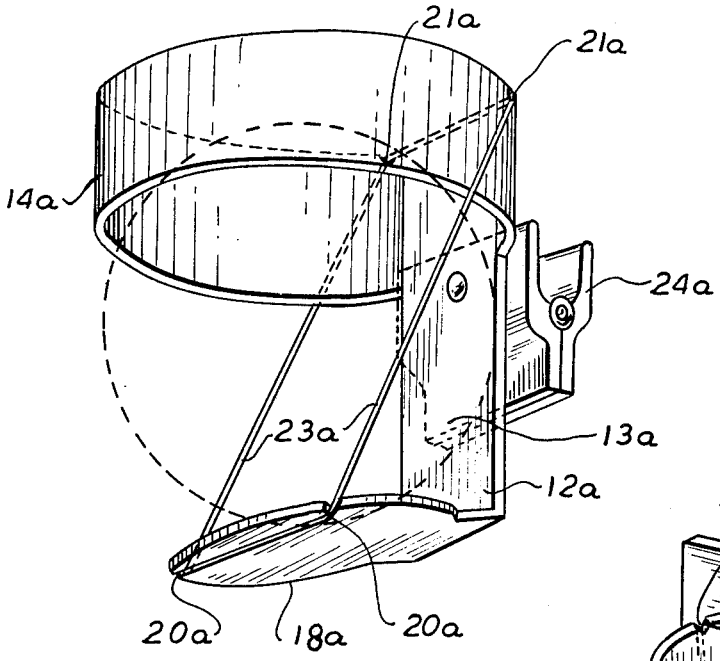
FIG. 4 is a perspective view of another ball holder of this invention for retaining one ball.

FIG. 4 shows a ball holder according to the invention designed to hold a single ball. Such a holder essentially comprises the lower half of the ball holder of FIG. 3 with the clamp 24 moved to a central position with regard to strut member 12. Elements identical to those of FIG. 3 are shown by identical reference numerals and the letter a. Loading and unloading of the holder is the same as described above.

Figure 5:
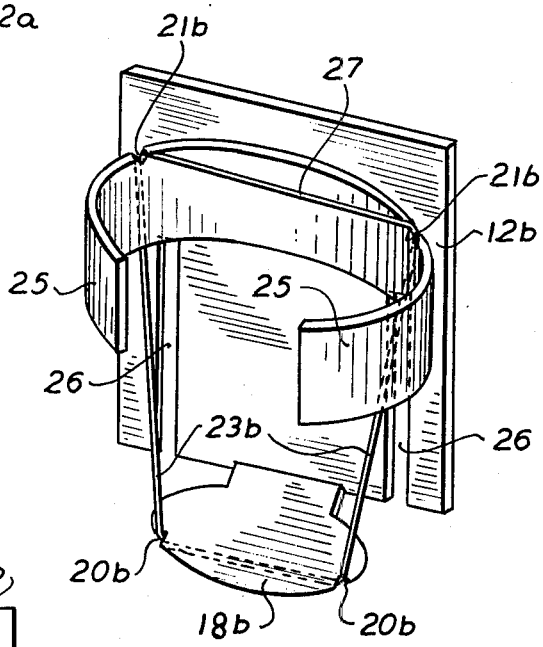
FIGS. 5 & 6 show a perspective and front view, respectively, of still another ball holder of this invention for retaining one ball.
Figure 6:
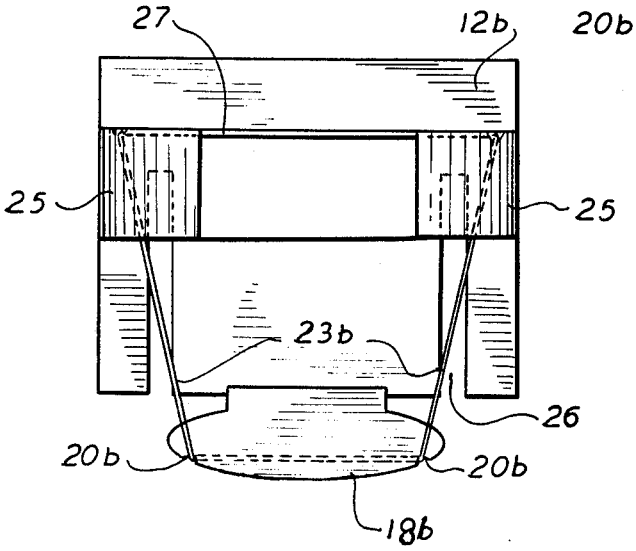

FIGS. 5 & 6 show a perspective and front view of still another one ball holder according to the invention. Elements identical to those of FIGS. 3 or 4 are shown by identical reference numerals and the letter b. In this embodiment the cylindrical ball retaining member 14*a* of FIG. 4 is substituted by a pair of curved ball gripping members 25 molded to the surface of strut member 12*b*. Such gripping members essentially comprise a cylindrical ball retaining member with an outer segment removed. The strut member 12*b* has a width of about the same as the inside diameter of the strut member i.e. 2⅝". The fastening means associated with the strut member 12*b* comprises a pair of vertical elongated slots 26 which fit over the waistband of the user's clothing to securely retain the holder on the user. This fastening means may also be substituted for the clamp shown in FIGS. 1 to 3.

To load the holder, a ball is inserted downwardly from the top of the strut members 25, pressed toward the body and rolled down over segment 27 of the elastic ball retaining member 23*b*. To unload the ball from the holder, the user inserts his fingers through the space between the curved ball gripping member 25, presses the ball towards the body and rolls the ball upward over segment 27 of the elastic ball retaining member 23*b*. Since the ball is pressed toward the body when loading or unloading the ball to and from the holder, there is no pressure on the wearer's attire.

The holders of this invention are also suitable for holding balls other than tennis balls such as golf balls, squash balls or hand balls for example, or any other small ball or balls used in individual or team sporting events. The dimensions of the holder are altered depending on the size of the ball or balls to be held. In such case, the strut member may be made shorter or longer; the planar ball retaining members may also be lengthened, shortened or changed in shape depending on the nature and size of the ball; and the cylindrical ball retaining member or arched ball gripping members are structured such that the inside diameter thereof is substantially the same as the diameter of a ball or balls to be retained in the holder.

I claim:

1. A ball holder carried on the person of a user and capable of retaining one or two balls comprising:
(a) a vertical strut member;
(b) an upper planar ball retaining member extending outwardly from the upper edge of said strut member;
(c) a lower planar ball retaining member extending outwardly from the lower edge of said strut member;
(d) a cylindrical ball retaining member joined to the central portion of said strut member and lying between said upper and lower planar ball retaining members;
(e) an upper pair of elastic ball retaining members extending from the outer region of said upper planar ball retaining member to said cylindrical ball retaining member;
(f) a lower pair of elastic ball retaining members extending from the outer region of said lower planar ball retaining member to said cylindrical ball retaining member; and
(g) means located on said strut member for fastening said holder to the clothing of said user.

2. A ball holder carried on the person of a user and being capable of retaining one or two balls comprising:
(a) a vertical strut member;
(b) an upper planar ball retaining member extending outwardly from the upper edge of said strut member;
(c) a lower planar ball retaining member extending outwardly from the lower edge of said strut member;
(d) a cylindrical ball retaining member joined to the central portion of said strut member between said upper and lower planar ball retaining members wherein the diameter of said cylindrical ball retaining member is approximately the same as the diameter of a ball retained by said holder;
(e) an upper pair of elastic ball retaining members extending from the outer regions of said upper planar ball retaining member to the lower edges of said cylindrical ball retaining member;
(f) a lower pair of elastic ball retaining members extending from the outer region of said lower planar ball retaining member to the upper inside edges of said cylindrical ball retaining member; and
(g) means located on said strut member for fastening said holder to the clothing of said user.

3. The ball holder of claim 2 wherein said upper pair of elastic ball retaining members comprises an elastic material extending from a first outer region of said upper planar ball retaining member to a first lower inside edge of said cylindrical ball retaining member, across the lower surface thereof to a second lower inside edge of said cylindrical ball retaining member and thence to a second outer region of said upper planar ball retaining member.

4. The ball holder of claim 2 wherein said lower pair of elastic ball retaining members comprises an elastic material extending from a first outer region of said lower planar ball retaining member to a first upper inside edge of said cylindrical ball retaining member across the upper surface thereof to a second upper inside edge of said cylindrical ball retaining member and thence to a second outer region of said lower planar ball retaining member.

5. The holder of claim 2 wherein said upper and lower planar ball retaining members extend outwardly from the upper and lower edge, respectively, of said strut member at an acute angle above and below, respectively, a plane normal to said strut member.

6. The holder of claim 5 wherein said acute angle is from about 10° to about 50°.

7. The holder of claim 5 wherein said acute angle is 20°.

8. A tennis ball holder capable of retaining one or two tennis balls comprising:
(a) a vertical strut member;
(b) an upper planar ball retaining member extending outwardly from the upper edge of said strut member at an angle of about 20° above a plane normal to said strut member; said member containing a pair of grooves notched in the outer edge thereof;
(c) a lower planar ball retaining member extending outwardly from the lower edge of said strut member at an angle of about 20° below a plane normal to said strut member; said member containing a pair of grooves notched in the outer edge thereof;
(d) a cylindrical ball retaining member joined to the central portion of said strut member and lying between said upper and lower planar ball retaining members and having a pair of upper grooves notched in the upper edge of said cylindrical ball retaining member adjacent said strut member and a pair of lower grooves notched in the lower edge of said cylindrical member adjacent said strut member; wherein the diameter of said cylindrical ball retaining member is approximately the same as the diameter of a tennis ball;

(e) an upper pair of elastic ball retaining members comprising a rubber band extending around the upper surface of said upper planar ball retaining member, through said grooves in said upper planar member to the lower grooves of said cylindrical member and around the lower portion of said cylindrical member adjacent said strut member; and (f) a lower pair of elastic ball retaining members comprising a rubber band extending around the lower surface of said lower planar ball retaining member through the grooves in said lower planar member to the upper grooves in said cylindrical ball retaining member and around the upper edge of said cylindrical member adjacent said strut member.

9. The holder of claim 8 wherein said strut member, said upper and lower planar ball retaining members and said cylindrical ball retaining member are comprised of a solid plastic.

10. The holder of claim 8 which further comprises means for fastening said strut member to the attire located at the top portion of said strut member.

11. The holder of claim 8 wherein said means for fastening is a clamp.

12. The holder of claim 8 wherein said strut member is about 4½ inches in length and about 1½ inches wide.

13. The holder of claim 8 wherein said cylindrical ball retaining member is about 1½ inches in width.

14. The holder of claim 8 wherein each of said upper and lower planar ball retaining members extends outwardly from said strut member about 2 inches.

15. A ball holder carried on the person of a user for holding a single ball comprising:

(a) a vertical strut member;

(b) a lower planar ball retaining member extending from the lower edge of said strut member;

(c) a cylindrical ball retaining member joined to said strut member above said planar ball retaining member having an inside diameter approximately the same as a ball to be carried by said holder;

(d) a pair of elastic ball retaining members extending from the outer regions of said lower planar ball retaining member to the upper inside edges of said cylindrical member; and (e) means associated with said strut member for fastening said holder to the clothing of said user.

16. The ball holder of claim 15 wherein said lower pair of elastic ball retaining members comprises an elastic material extending from a first outer region of said lower planar ball retaining member to a first upper inside edge of said cylindrical ball retaining member across the upper surface thereof to a second upper inside edge of said cylindrical ball retaining member and thence to a second outer region of said lower planar ball retaining member.

17. The ball holder of claim 15 wherein said lower planar ball retaining member extends outwardly from the lower edge of said strut member at an acute angle below a plane normal to said strut member.

18. The ball holder of claim 17 wherein said angle is between about 10 and 50 degrees.

19. A ball holder of claim 17 wherein said angle is about 20°.

20. A ball holder carried on the person of a user for holding a single ball comprising:

(a) a vertical strut member;

(b) a lower planar ball retaining member extending from the lower edge of said strut member;

(c) a pair of arched ball gripping members joined to said strut member and forming an open space therebetween;

(d) a pair of elastic ball retaining members extending from the outer regions of said lower planar ball retaining member to the upper inside edges of said ball gripping members; and (e) means associated with said strut member for fastening said holder to the clothing of said user.

21. The ball holder of claim 20 wherein said lower planar ball retaining member extends outwardly from the lower edge of said strut member at an acute angle below a plane normal to said strut member.

22. The ball holder of claim 21 wherein said angle is between about 10 and 50 degrees.

23. The ball holder of claim 21 wherein said angle is about 20°.

24. The ball holder of claim 23 wherein said fastening means comprises a pair of vertical elongated slots.

25. A ball holder carried on the person of a user for holding a single ball comprising:

(a) a strut member having a pair of vertical elongated slots located therein;

(b) a lower planar ball retaining member extending from the lower edge of said strut member;

(c) a pair of arched ball gripping members joined to said strut member and forming an open space therebetween; and (d) an elastic band material extending from a first outer region of said lower planar ball retaining member to the upper inside edge of one of said pair of arched ball gripping members, across the upper surface of said ball gripping members to the upper inside edge of the other of said pair of gripping members and thence to a second outer region of said lower planar ball retaining members.

26. The ball holder of claim 25 wherein said lower planar ball retaining member extends outwardly from the lower edge of said strut member to an acute angle below a plane normal to said strut member.

27. The ball holder of claim 26 wherein said angle is between about 10 and 50 degrees.

28. The ball holder of claim 26 wherein said angle is about 20°.

* * * * *